US011092032B2

(12) United States Patent
Urac et al.

(10) Patent No.: US 11,092,032 B2
(45) **Date of Patent: *Aug. 17, 2021**

(54) VARIABLE VANE ACTUATING SYSTEM

(71) Applicant: PRATT & WHITNEY CANADA CORP., Longueuil (CA)

(72) Inventors: Tibor Urac, Mississauga (CA); Esther Leung, Markham (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 178 days.

This patent is subject to a terminal disclaimer.

(21) Appl. No.: 16/543,887

(22) Filed: Aug. 19, 2019

(65) Prior Publication Data

US 2020/0072074 A1 Mar. 5, 2020

Related U.S. Application Data

(60) Provisional application No. 62/723,684, filed on Aug. 28, 2018, provisional application No. 62/723,708, filed on Aug. 28, 2018.

(51) Int. Cl.

| | |
|---|---|
| ***F01D 17/16*** | (2006.01) |
| ***F02B 37/24*** | (2006.01) |
| ***F04D 27/00*** | (2006.01) |
| ***F01D 9/04*** | (2006.01) |

(52) U.S. Cl.

CPC ..... *F01D 17/162* (2013.01); *F01D 9/041* (2013.01); *F02B 37/24* (2013.01); *F04D 27/002* (2013.01); *F05D 2220/32* (2013.01); *F05D 2240/12* (2013.01)

(58) Field of Classification Search

CPC ..... F01D 17/162; F01D 9/041; F02B 37/24; F04D 27/002

See application file for complete search history.

(56) References Cited

U.S. PATENT DOCUMENTS

| | | | | |
|---|---|---|---|---|
| 4,035,101 | A * | 7/1977 | Glenn | F01D 17/162 415/160 |
| 4,498,790 | A * | 2/1985 | Fisher | F01D 17/162 384/296 |
| 4,741,666 | A * | 5/1988 | Shimizu | F02B 37/24 415/158 |

(Continued)

FOREIGN PATENT DOCUMENTS

| | | |
|---|---|---|
| CN | 201228563 | 4/2009 |
| CN | 201460998 | 5/2010 |

(Continued)

OTHER PUBLICATIONS

European Search Report issued in counterpart EP application No. 19194195.4 dated Dec. 10, 2019.

*Primary Examiner* — Woody A Lee, Jr.
*Assistant Examiner* — Brian Christopher Delrue
(74) *Attorney, Agent, or Firm* — Norton Rose Fulbright Canada LLP

(57) ABSTRACT

A variable guide vane (VGV) apparatus has a variable guide vane (VGV) rotatable about a vane rotation axis. An actuating arm is mounted to the VGV. The actuating arm has a fork defining a slot for receiving a drive pin. The slot is profiled to accommodate angular misalignment between the pin and the fork throughout a range of motion of the associated pin along the slot.

17 Claims, 6 Drawing Sheets

(56) References Cited

U.S. PATENT DOCUMENTS 5,215,434 A * 6/1993 Greune ..... F01D 17/162 415/150
5,314,301 A * 5/1994 Knight ..... F01D 5/148 415/160
6,457,937 B1 * 10/2002 Mashey ..... F04D 29/563 415/160
6,551,057 B1 * 4/2003 Haaser ..... F01D 17/162 415/119
6,699,010 B2 * 3/2004 Jinnai ..... F01D 17/16 415/164
6,779,971 B2 * 8/2004 Garrett ..... F01D 17/165 415/156
6,984,105 B2 * 1/2006 Clark ..... F01D 17/162 415/160
7,186,077 B2 * 3/2007 Daudel ..... F01D 17/165 415/164
7,273,346 B2 * 9/2007 Bouru ..... F01D 17/162 415/162
7,300,245 B2 * 11/2007 Bouru ..... F01D 17/162 415/147
7,322,790 B2 * 1/2008 Bouru ..... F01D 17/162 415/162
9,200,640 B2 * 12/2015 Patil ..... F04D 29/462
9,429,033 B2 * 8/2016 Martin ..... F01D 17/16
9,644,491 B2 * 5/2017 Zhou ..... F04D 29/563
9,784,117 B2 * 10/2017 Duguay ..... F01D 11/14
9,784,365 B2 * 10/2017 Marshall ..... F16H 57/12
9,790,949 B2 * 10/2017 Tashiro ..... F04D 27/002
10,006,332 B2 * 6/2018 Kuma ..... F01N 3/0253
10,837,310 B2 * 11/2020 Lummer ..... F01D 25/16
2008/0035112 A1 * 2/2008 Yamaguchi ..... F02B 39/16 123/436
2010/0150701 A1 * 6/2010 Simon ..... F04D 29/462 415/160
2012/0315164 A1 * 12/2012 Mayernick ..... F02C 6/12 417/406
2015/0016968 A1 * 1/2015 Grabowska ..... F02B 37/22 415/148
2015/0086340 A1 * 3/2015 Ramb ..... F04D 27/002 415/148
2015/0361820 A1 * 12/2015 Zhou ..... F04D 29/563 415/148
2015/0369079 A1 * 12/2015 McCaffrey ..... F01D 17/16 415/148
2016/0230586 A1 * 8/2016 King ..... F01D 17/165
2016/0298534 A1 * 10/2016 Lotz ..... F01D 17/105
2017/0226888 A1 * 8/2017 Howell ..... F01D 17/165
2017/0276011 A1 * 9/2017 Chandler ..... F01D 9/042
2017/0276148 A1 * 9/2017 Suciu ..... F01D 9/042

FOREIGN PATENT DOCUMENTS

CN 201474729 5/2010
CN 201884075 U 6/2011
CN 201884076 6/2011
CN 202348349 U 7/2012
CN 202370599 8/2012
CN 203584478 5/2014
CN 103089344 6/2015
CN 125789553 6/2015
CN 105626164 8/2017
CN 207728436 8/2018
CN 108825362 11/2018
GB 880903 10/1961
GB 2400416 A 10/2004
GB 2400633 3/2005
JP 4044392 7/1992
JP 2004084545 3/2004
JP 03714041 B2 11/2005
JP 05071421 3/2009
JP 2010065591 3/2010
JP 5071421 11/2012
WO 1999050533 10/1999
WO WO2015026654 A1 2/2015
WO 2016059300 4/2016

* cited by examiner

VARIABLE VANE ACTUATING SYSTEM

CROSS REFERENCE TO RELATED APPLICATIONS

The present application claims priority on U.S. Provisional Patent Application No. 62/723,684, filed on Aug. 28, 2018 and U.S. Provisional Patent Application No. 62/723,708, filed on Aug. 28, 2018, the entire content of which is herein incorporated by reference.

TECHNICAL FIELD

The application relates generally to an apparatus for actuating a variable guide vane in a compressor or a turbine.

BACKGROUND OF THE ART

Gas turbine engines sometimes have variable guide vanes (VGVs) disposed in an inlet section of an airflow duct of a compressor or turbine section. The guide vanes are adjustable in an angular orientation in order to control the airflow being directed through the airflow duct. An actuator positioned outside the airflow duct is conventionally used to actuate adjustment of the angular orientation of the VGVs. Various torque transfer arrangements have been created for connection between the actuator and the VGVs.

For VGV actuating systems with radial VGV (vanes oriented generally radially relative to the engine centerline), the VGV system is typically designed with a rotary actuator and vane actuating links. The contact between the rotary actuator and the actuating links has to be reduced in order to cater for greater VGV angle range. This results in increased wear at the link-actuator interface which leads to system inaccuracy.

SUMMARY

In accordance with a general aspect, there is provided a variable guide vane apparatus for a compressor or a turbine, comprising: a unison ring rotatable about a central axis thereof, the unison ring having an array of circumferentially spaced-apart drive pins; a set of variable guide vanes (VGV) circumferentially distributed around the central axis and mounted for rotation about respective spanwise axes of the vanes, the spanwise axes extending non-parallel to the central axis of the unison ring; and a plurality of actuating arms operatively connected to respective variable guide vanes for rotation therewith, the actuating arms each including a fork having a pair of spaced apart fingers with inwardly facing surfaces defining a slot therebetween, a corresponding one of said drive pins slidably received in the slot; wherein in a plane normal to a longitudinal axis of the slot, the inwardly facing surfaces have opposed end portions flaring outwardly from an intermediate throat in a direction away from the slot.

In accordance with another general aspect, there is provided a gas turbine engine comprising: a casing circumferentially extending around a central axis, vanes circumferentially distributed around the central axis, the vanes rotatably mounted to the casing for rotation about respective spanwise axes of the vanes, the spanwise axes of the vanes being transversal to the central axis, a unison ring mounted for rotation about the central axis; drive pins mounted to the unison ring; actuating arms operatively connected to respective vanes for rotation therewith, each actuating arm including a fork having a pair of fingers with inwardly facing surfaces defining a slot, an associated pin of the drive pins slidably engaged in the slot, the inwardly facing surfaces of the slot being profiled with top and bottom outwardly flaring sections to accommodate angular misalignment between the associated pin and the fork throughout a range of motion of the associated pin along the slot.

DESCRIPTION OF THE DRAWINGS

Reference is now made to the accompanying figures in which.

DETAILED DESCRIPTION

Figure 1:
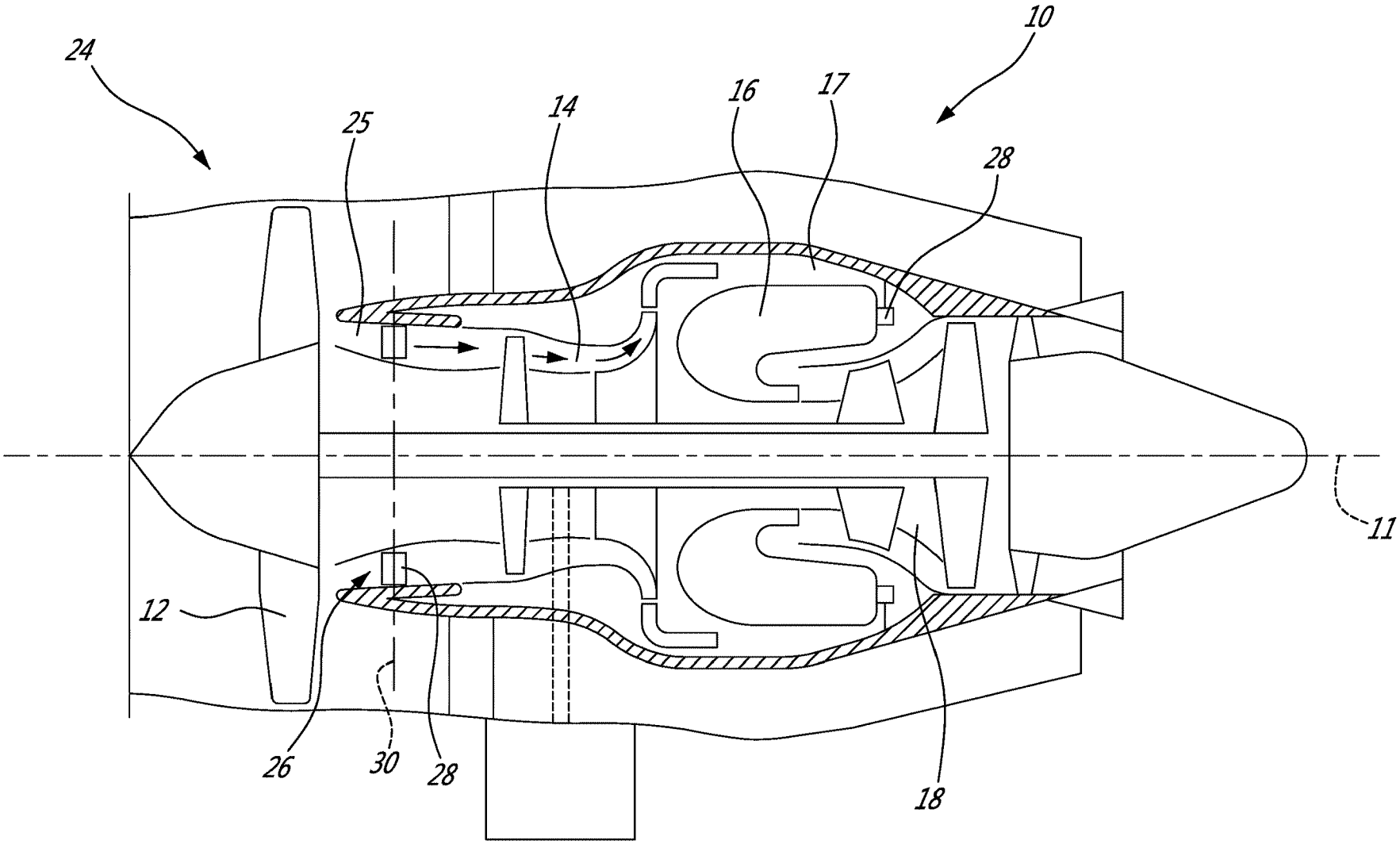
FIG. 1 is a schematic cross-sectional view of a gas turbine engine.

FIG. 1 illustrates an example of a gas turbine engine. In this example, the turbine engine 10 is a turbofan engine generally comprising in serial flow communication a fan 12, a compressor section 14 for pressurizing air, a combustor 16 in which the pressurized air is mixed with fuel and ignited for generating an annular stream of hot combustion gases, and a turbine section 18 for extracting energy from the combustion gases.

It should be noted that the terms "axial", "radial" and "circumferential" are used with respect to the centerline or central axis 11 of the engine 10.

In this example, the compressor section 14 defines an annular airflow duct 25 having an axial inlet section (not numbered) to direct an airflow axially inwardly into the annular airflow duct 25 of the compressor section 14, as indicated by the flow arrows. A variable guide vane (VGV) apparatus 26 is mounted to the compressor section 14 and has a plurality of variable inlet guide vanes 28 (VIGVs) positioned and rotatably supported within the inlet section of the airflow duct 25. The VIGVs 28 are rotatable about respective spanwise axes 30 thereof, which are angled to the central axis 11 of the engine (i.e. non-parallel to the engine axis 11). The angular orientation of the VIGVs 28 about the respective spanwise axes 30 is adjustable such that the airflow entering the inlet section of the airflow duct 25 is controlled by the VIGVs 28. The VIGVs are configured to orient the flow before entering the first stage of compressor blades of the compressor section 14. The VGV apparatus is configured to vary an angle of attack of its vanes depending of the operating conditions of the gas turbine engine. However, it is understood that VGVs may be used at other locations within the engine 10.

Figure 2:
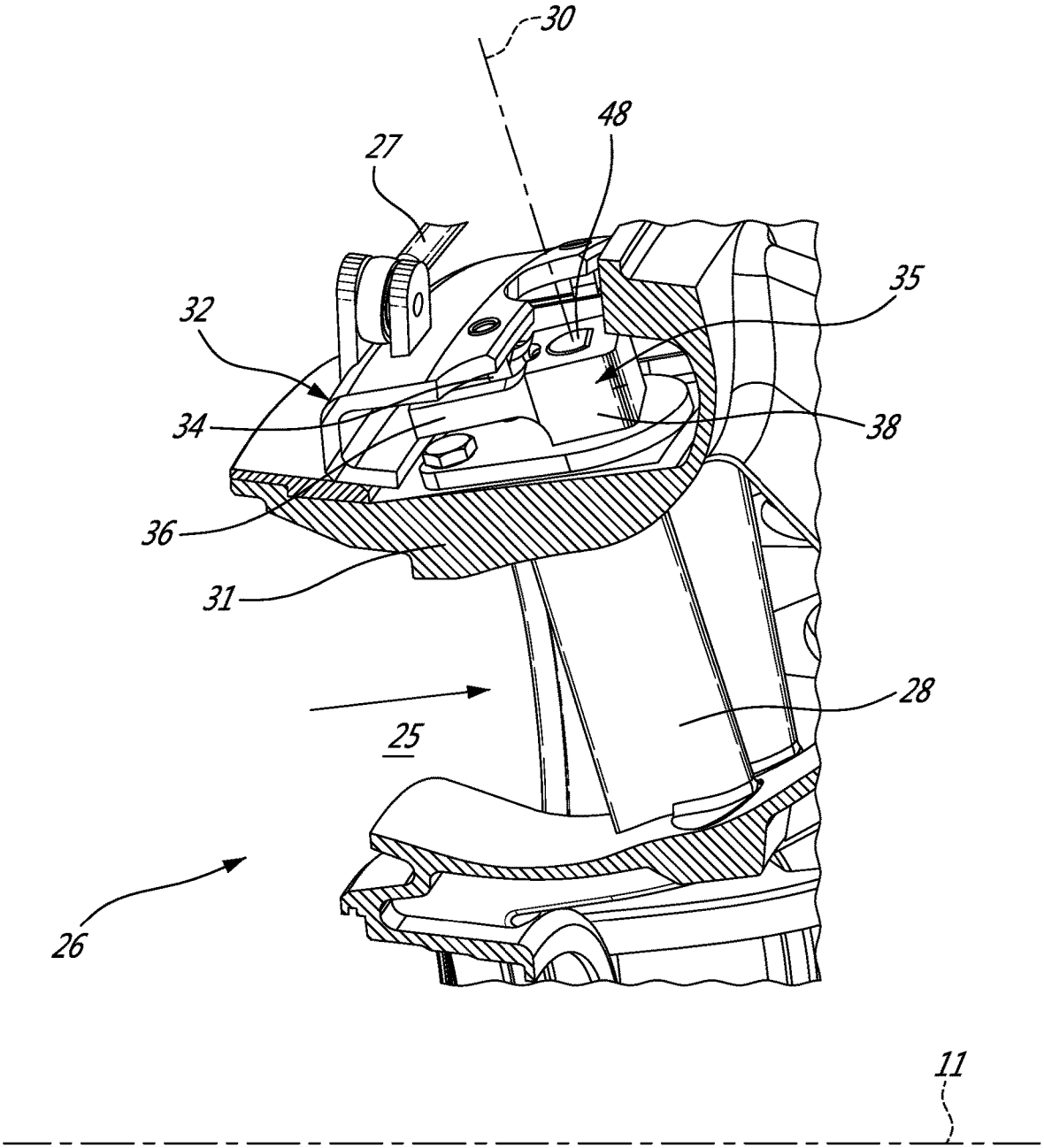
FIG. 2 is an isometric view of a VGV apparatus.
Figure 3:
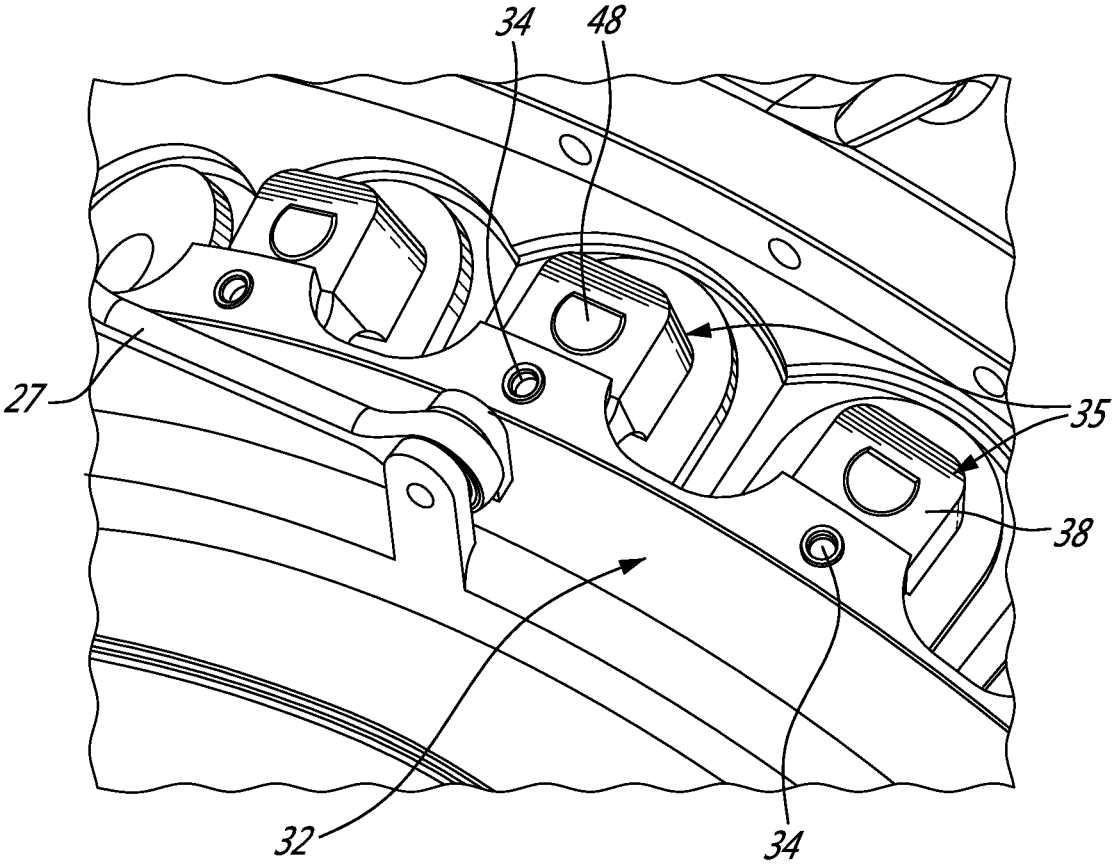
FIG. 3 is a top view of the VGV apparatus.
Figure 4:
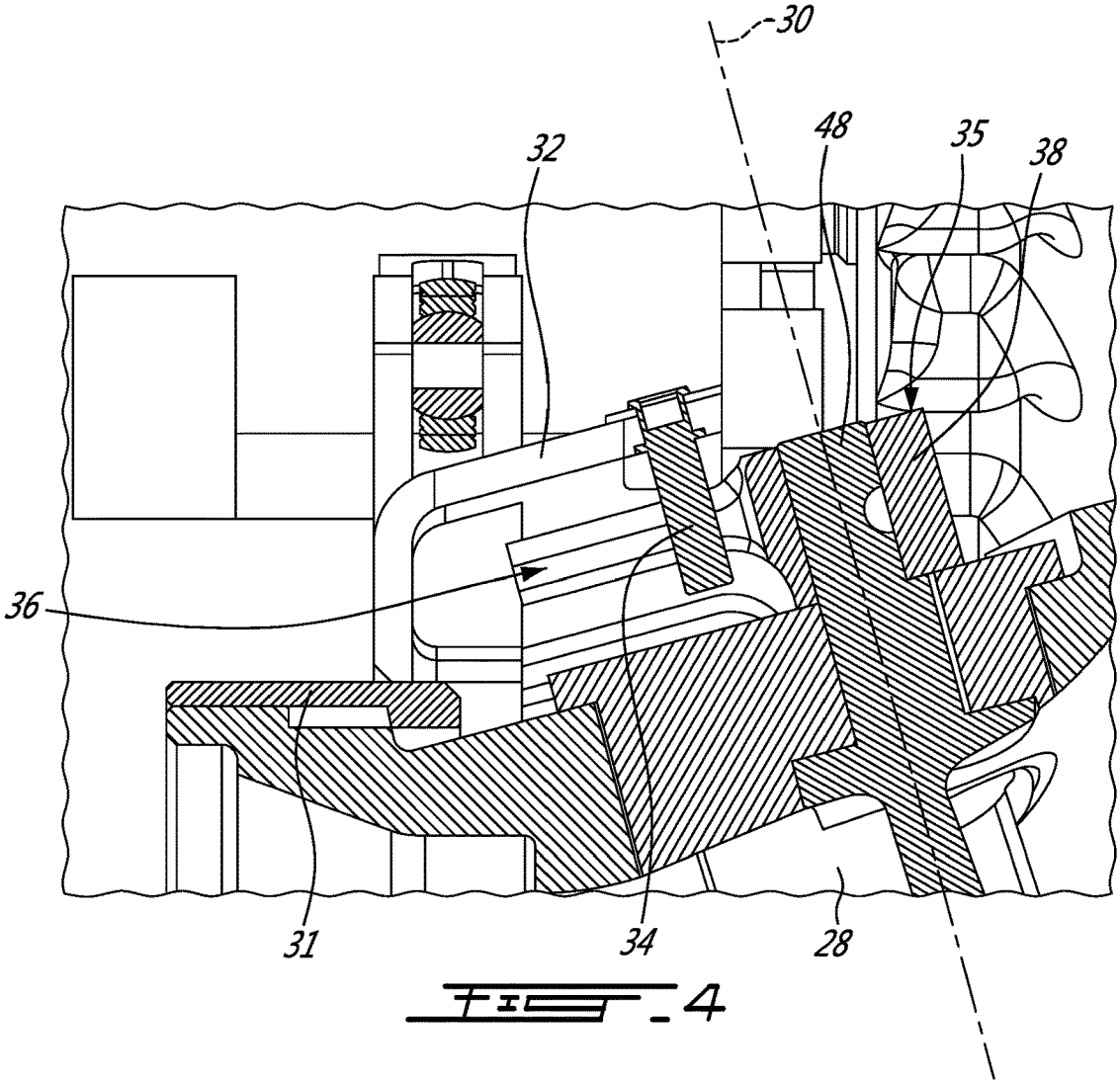
FIG. 4 is a cross-section view illustrating a metal drive pin installed on an unison ring for engagement between the forks of an actuating arm.
Figure 5:
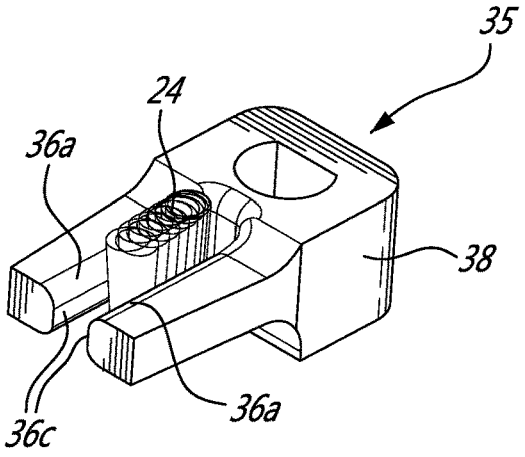
FIG. 5 is an isometric view of an actuating arm including a base and a pair of forks having profiled surfaces.
Figure 6:
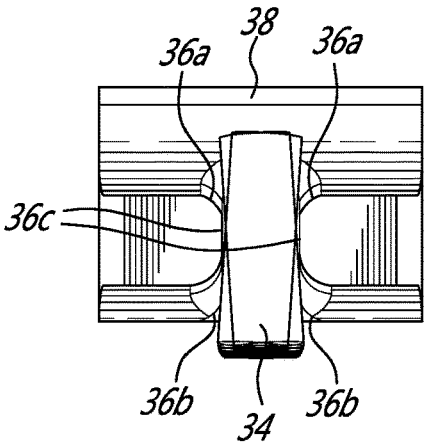
FIG. 6 is an end view illustrating the variable fork profile to increase contact area between pin and fork throughout the VGV angle range while allowing for pin angle changes.

Referring concurrently to FIGS. 2-10, the apparatus 26 may further include a unison ring 32 having a central axis axially aligned with the central axis 11 of the engine 10. The unison ring 32 is supported in the engine 10, for example, directly on the outer diameter of the casing 31 forming the annular air duct 25. The unison ring 32 is mounted for rotation over the casing 31. As shown in FIG. 2, an actuator 27 is connected to the unison ring 32 to rotate the unison ring in a selected direction on the casing 31. The actuator 27 can take various forms. For instance, it can be provided in the form of a linear actuator, such as a piston and cylinder arrangement, configured to apply a tangential force to the ring 32 so as to rotate the ring 32 about its central axis on the casing 31. As best shown in FIGS. 2 and 4, the unison ring 32 may have a cantilevered portion carrying an array of circumferentially spaced-apart drive pins 34 for engagement with respective actuating links 35, which are, in turn, operatively connected to respective VIGVs 28 to transfer a torque from the unison ring 32 to the VIGVs 28 and, thus, cause the same to rotate about their respective axes 30. As can be appreciated from FIG. 4, the drive pins 34 may project generally radially inwardly from an inner diameter of the cantilevered portion of the unison ring 32. The drive pins 34 may be removably mounted in corresponding circumferentially spaced-apart holes define in the cantilevered portion of the unison ring 32.

According to one embodiment, the actuating link or arm 35 has a base 38 and a fork 36 having a pair of spaced-apart fingers extending in a parallel relationship from the base 38. The base 38 defines a central opening for receiving a stem 48 projecting from a radially outer end of each VIGV 28. The stem 48 may be connected to or integrated with each of the VIGVs 28, and extending coaxially with respect the axis 30 of the associated VIGV 28. For example, as shown in FIG. 2, the stem 48 may have a cylindrical section rotatably supported in the engine to thereby define the rotation axis 30 of the respective VIGVs 28. The stem 48 according to one embodiment may include an end section rigidly connected or keyed to the base 38 of an associated actuating arm 35 via any suitable connections, such as bolts and the like. The end section of the stem 48 and the corresponding central opening in the base 38 of the actuating arm 35 may have flat sides (i.e. planar surfaces) to transmit a torque from the actuating arm 35 to the VIGV 28 about axis 30.

Figure 7:
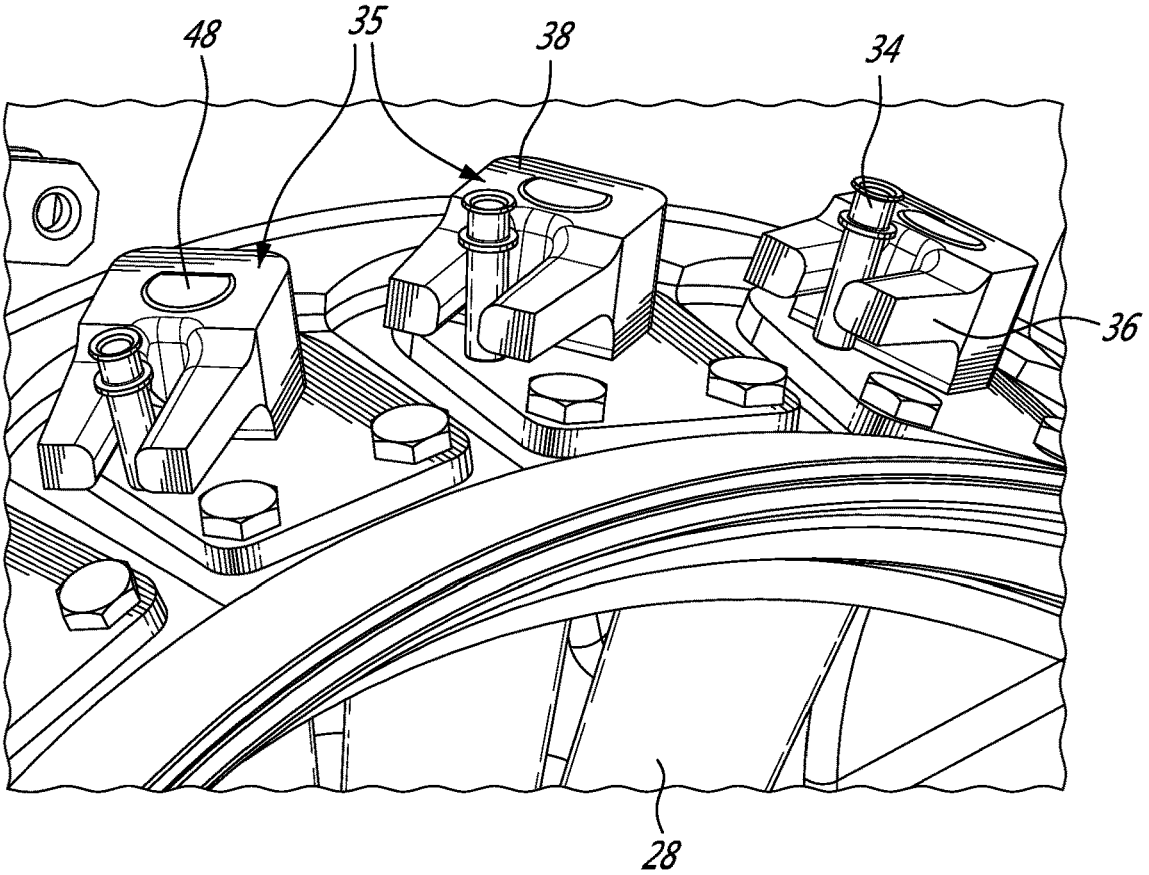
FIG. 7 illustrates the VGVs in a fully closed position.
Figure 8:
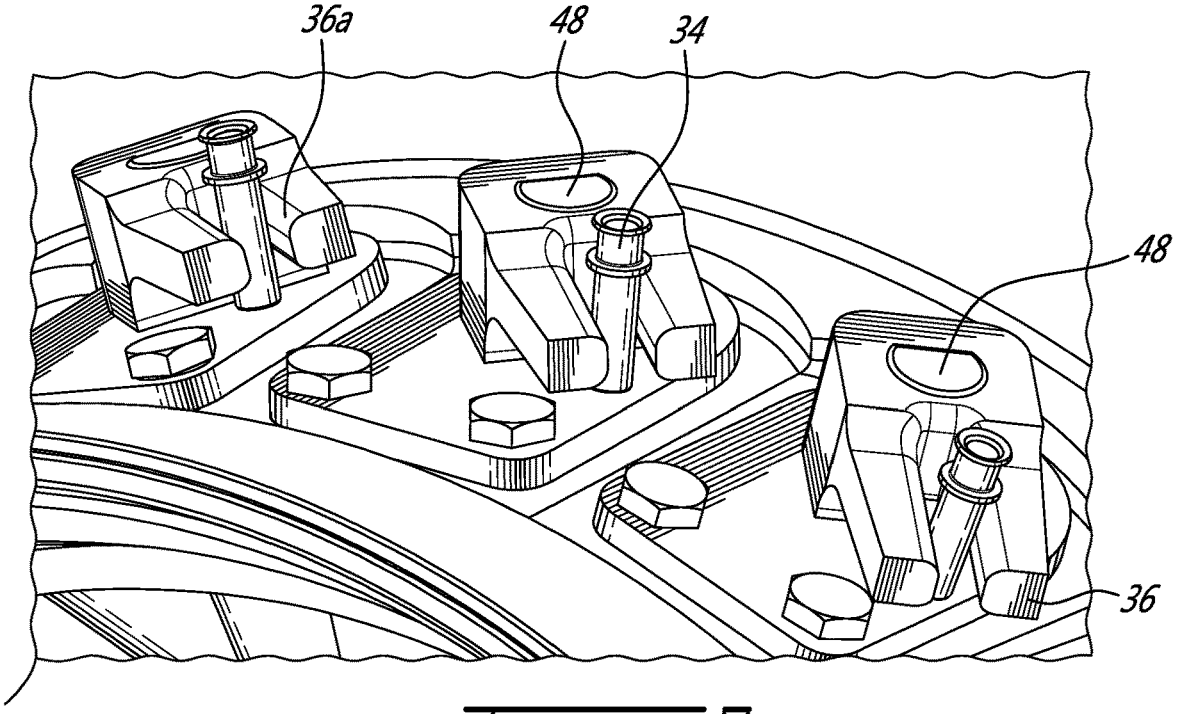
FIG. 8 illustrates the VGVs in a fully open position.

As best shown in FIGS. 5, 7, 8 9*a* and 10*a*, the fork 36 and the base 38 define a U-shaped profile. The fingers of the fork 36 in combination define an open ended slot therebetween into which an associated one of the drive pins 34 may be slidably received. When the unison ring 32 is circumferentially adjusted (i.e. rotated) about its axis, each of the drive pins 34 which is affixed on the unison ring 32, moves together with the unison ring 32 in the circumferential direction to drive an associated one of the actuating arms 35 (which is connected with the stem 48) to rotate together with the stem 48 about the respective rotational axes 30 of the VIGVs 28, resulting in adjustment of the angular orientation of the respective VIGVs 28 in order to control the airflow entering the inlet section of the air duct 25. As shown in FIGS. 7 and 8, the VIGVs 28 are pivotable about their respective axes 30 between a fully closed position (FIG. 7) and a fully open position (FIG. 8). The drive pin 34 is allowed to slide along the slot defined between two fingers of the fork 36 when the drive pin 34 drives the actuating arm 35 in rotation about the vane rotation axis 30. In this way, the mounting arrangement of the unison ring 32 can be simplified as the ring 32 only has to be movable (i.e. rotatable) in the circumferential direction. The ring 32 does not have to slide axially to account for the relative axial movement between the pins 34 and the actuating arms 36. This relative movement is rather accommodated by the axially elongated component of the slots defined by the fork 36.

Figure 9A:
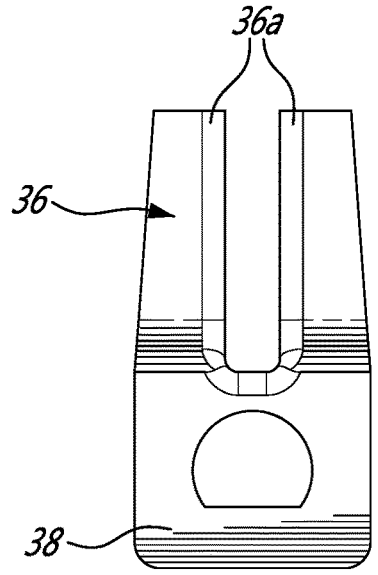
FIGS. 9*a* and 9*b* illustrate a pin-fork interface for a straight fork.
Figure 9B:
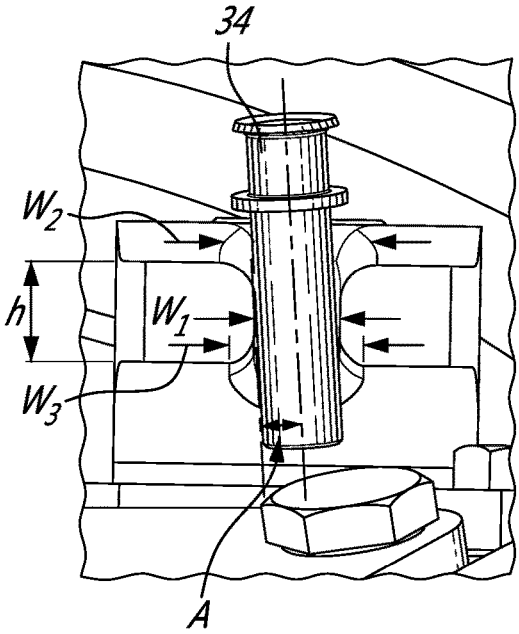

Also, as the pivot axes 30 of the vanes 28 are not parallel to engine axis 11 and, thus, to the rotation axis of the unison ring 32, but rather oriented at an angle with respect thereto. As a result and as shown in FIGS. 9*b* and 10*b*, the angle A between the pins 34 and the fork 36 changes through the range of motion of the unison ring 32. Indeed, for applications where the VGVs are angled with respect the engine centerline 11 and the unison ring 32 (e.g. VIGVs perpendicular to the engine axis 11) the movement of the unison ring 32 introduces a twisting motion between the drive pins 34 and the forks 36. As the unison ring 32 rotates, the pins 34 slide along the slots and as the pins slide, the relative position of the pins 34 and the forks 36 introduces an angular misalignment that needs to be accounted for. This is schematically depicted in FIGS. 5,6, 9*b* and 10*b*.

As shown in FIGS. 6, 9*a*, 9*b*, 10*a* and 10*b*, the angular movement of the drive pins 34 in the slots can be accommodated by profiling the forks 36. For instance, this can be done by introducing a curvature in the forks 36 to give freedom for the drive pins 34 to actually angularly move or tilt with respect to the forks 36. According to the illustrated embodiments, the inwardly facing surfaces of the forks 36 may have a top and a bottom rounded or curved section 36*a*, 36*b* and a central flatten section 36*c*. Such a variable profile of the inwardly facing surface of the forks 36 in a plane normal to the longitudinal axis of the slot is configured to accommodate the angular motion of the pin 34 relative to the forks 36 while at the same time maximizing the surface contact area between the pins 34 and the forks 36. The rounded sections 36*a*, 36*b* including the top and bottom rounded edges on the opposed facing surfaces of the pairs of fingers of the forks 36 provide the room required to accommodate the relative angular movement while the flatten profile of the central or intermediate section 36*c* maximizes the contact area and, thus, minimize wear.

Alternatively, the fork profiled surface could be designed as a single radius from top to bottom of the fork arm or even chamfered top and bottom of the fork with the pin contact interface as a line contact. Nonetheless, combining a flatten area with outwardly flaring top and bottom areas allows to increase contact area to minimize wear rate while providing the required freedom of angular movement between the pin the forks. With such a pin-fork arrangement, the interface can then be optimized to increase the contact surface between the pin and fork.

According to these embodiments, the width of the slot varies along the height (h) of the slot. This can be appreciated from FIG. 9*b*. Indeed, the width W3 at the bottom of the slot and the width W2 at the top of the slot are greater than the width W1 at an intermediate or mid region of the slot. This width distribution provide for top and bottom sections flaring outwardly from a central throat region. It defines two outwardly diverging end sections linked by a bridge or throat section. This slot geometry is configured to accommodate the tilting motion of the pin relative to the forks while the pin slides along the slot.

Therefore, according to at least some embodiments, the accuracy and durability at the pin-fork interface may be improved by: 1) introducing variable profile to the fork surface to allow for drive pin angle change over full range of motion of the vanes.

Figure 10A:
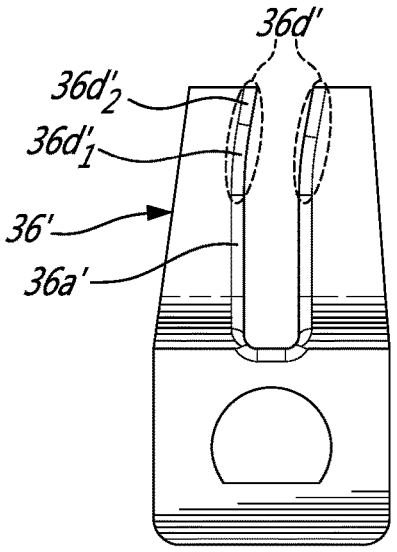
FIGS. 10*a* and 10*b* illustrate a pin-fork interface for a fork with a longitudinally extending curvature contour.
Figure 10B:
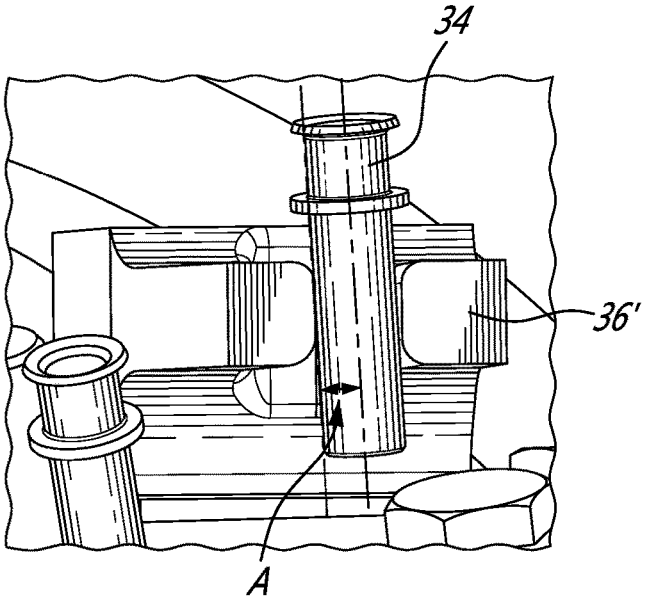

Furthermore, as shown in FIGS. 10*a* and 10*b* instead of having longitudinally straight forks (FIGS. 9*a*, 9*b*), the forks 36' may be designed to offer a non-rectilinear longitudinally extending cam surface for the pins 34. For instance, as shown in FIG. 10*a*, the forks 36 may be curved in the longitudinal direction to provide for a non-rectilinear slot. More particularly, according to the illustrated embodiment, the distal end portion 36d' of the forks have a curved contour to act as a vane angle schedule adjustment. The forks 36' thus define a curved or bent slot allowing the forks 36' to act as a "cam" to actually change the vane angle schedule. By so introducing a profile change along at least a portion of the length of the forks 36', the vane angle schedule can be changed/adjusted for a given unison ring stroke. That is with the bent slot design shown in FIGS. 10*a*, 10*b*, it is possible to use the fork itself to change the vane angle schedule of the vanes while keeping a simple common actuating system. In other words, with the same movement of the actuator, different vane angle responses can be obtained by simply changing the longitudinal shape of the forks 36'. In the illustrated example, the curved distal end portion 36d' of the forks includes two serially interconnected longitudinal segments 36d'1, 36d'2 defining a different degree of curvature. It is understood that the curved or bent can be composed of any desired number of differently oriented segments.

As shown in FIGS. 2 and 4, the unison ring 32 can ride directly on the radially outer surface of casing 31. The unison ring 32 and the casing 31 are designed so that the inner diameter surface of the ring 32 matches the outer diameter surface of the casing 31, thereby allowing the ring 32 to circumferentially slide on the casing 31. The union ring 32 can, for instance, be made of a wear resistant composite material similar to materials used for sliding bumper pads to avoid metal to metal rubbing between the unison ring and casing. This eliminates the need for any intermediate slider bushing pads, bearings or tracks between the casing and the unison ring. The casing 31 can be made out of metal or any other suitable material. Such an arrangement allows to simplify and to improve the system durability between the unison ring and casing interface.

The above description is meant to be exemplary only, and one skilled in the art will recognize that changes may be made to the embodiments described without departing from the scope of the invention disclosed. For example, it is understood that the various features of the VGV actuating system are not limited to turbofan applications. Indeed, they could be applied to any engines, including turboshaft, turboprop, APU engines as well as non-gas turbine engines. Also, it is understood that the VGVs are not limited to VIGVs as exemplified herein above. Any variable guide vane apparatus having VGVs with pivotal axes angled to the engine centerline could benefit from the various aspects of the present invention. For instance, VGVs apparatus in the turbine section of the engine could integrate at least some of the various features described herein above. Still other modifications which fall within the scope of the present invention will be apparent to those skilled in the art, in light of a review of this disclosure, and such modifications are intended to fall within the appended claims.

The invention claimed is:

1. A variable guide vane apparatus for a compressor or a turbine, comprising:

a unison ring rotatable about a central axis thereof, the unison ring having an array of circumferentially spaced-apart drive pins;

a set of variable guide vanes (VGV) circumferentially distributed around the central axis and mounted for rotation about respective spanwise axes of the vanes, the spanwise axes extending non-parallel to the central axis of the unison ring; and a plurality of actuating arms operatively connected to respective variable guide vanes for rotation therewith, the actuating arms each including a fork having a pair of spaced apart fingers with inwardly facing surfaces defining a slot therebetween, a corresponding one of said drive pins slidably received in the slot;

wherein in a plane normal to a longitudinal axis of the slot, the inwardly facing surfaces have opposed end portions flaring outwardly from an intermediate throat in a direction away from the slot;

wherein the fork has a non-rectilinear cam surface in sliding engagement with the corresponding drive pin; said cam surface curves to create a profile change along at least a portion of the length of the forks.

2. The variable guide vane apparatus according to claim 1, wherein the intermediate throat comprises a flatten section, and wherein the opposed end portions are curved.

3. The variable guide vane apparatus according to claim 1, wherein the slot has a height (h) extending between the opposed end portions of the inwardly facing surfaces, and wherein a width of the slot varies along the height.

4. The variable guide vane apparatus according to claim 3, wherein the slot has an intermediate width (W1) at the intermediate throat, a top width (W2) and a bottom width (W3) respectively at a top and a bottom end of the slot, the top width (W2) and the bottom width (W3) being greater than the intermediate width (W1).

5. The variable guide vane apparatus according to claim 4, wherein the top width (W2) and the bottom width (W3) are the same.

6. The variable guide vane apparatus according to claim 1, wherein the inwardly facing surfaces defines a single radius of curvature between a top and a bottom edge of the slot.

7. The variable guide vane apparatus according to claim 1, wherein the fork has curved distal end portions.

8. The variable guide vane apparatus according to claim 1, wherein in a longitudinal plane of the fork, the spaced apart fingers are curved in a longitudinal direction thereof to provide for a non-rectilinear slot profile of the slot.

9. A gas turbine engine comprising:

a casing circumferentially extending around a central axis, vanes circumferentially distributed around the central axis, the vanes rotatably mounted to the casing for rotation about respective spanwise axes of the vanes, the spanwise axes of the vanes being transversal to the central axis, a unison ring mounted for rotation about the central axis;

drive pins mounted to the unison ring;

actuating arms operatively connected to respective vanes for rotation therewith, each actuating arm including a fork having a pair of fingers with inwardly facing surfaces defining a slot, an associated pin of the drive pins slidably engaged in the slot, the inwardly facing surfaces being profiled with top and bottom outwardly flaring sections to accommodate angular misalignment between the associated pin and the fork throughout a range of motion of the associated pin along the slot:

wherein the fork defines a non-rectilinear longitudinally extending cam surface in sliding engagement with the associated pin; said cam surface curves to create a profile change along at least a portion of the length of the forks.

10. The gas turbine engine according to claim 9, wherein the top and bottom outwardly flaring sections flare from a throat.

11. The gas turbine engine according to claim 10, wherein the throat comprises a flatten section, and wherein the top and bottom outwardly flaring sections are curved.

12. The gas turbine engine according to claim 9, wherein the slot has a height (h), and wherein a width of the slot varies along the height.

13. The gas turbine engine according to claim 12, wherein the slot has an intermediate width (W1), a top width (W2) and a bottom width (W3), the top width (W2) and the bottom width (W3) being greater than the intermediate width (W1).

14. The gas turbine engine according to claim 10, wherein the fork has curved distal end portions.

15. The gas turbine engine according to claim 9, wherein the fork is curved in a longitudinal direction thereof to provide for a non-rectilinear slot profile of the slot.

16. The gas turbine engine according to claim 9, wherein the unison ring rides directly on a radially outer surface of the casing.

17. A variable guide vane apparatus for a compressor or a turbine, comprising:

a unison ring rotatable about a central axis thereof, the unison ring having an array of circumferentially spaced-apart drive pins;

a set of variable guide vanes (VGV) circumferentially distributed around the central axis and mounted for rotation about respective spanwise axes of the vanes, the spanwise axes extending non-parallel to the central axis of the unison ring; and a plurality of actuating arms operatively connected to respective variable guide vanes for rotation therewith, the actuating arms each including a fork having a pair of spaced apart fingers with surfaces facing one another to define a slot therebetween configured to slidingly receive an associated pin of said drive pins;

the surfaces having top and bottom end portions flaring outwardly in a direction away from the slot;

wherein the fork has a non-rectilinear cam surface in sliding engagement with the corresponding drive pin; said cam surface curves to create a profile change along at least a portion of the length of the forks.

* * * * *